US005683144A

United States Patent [19]

Kammerer et al.

[11] Patent Number: 5,683,144

[45] Date of Patent: Nov. 4, 1997

[54] CUTTING ELEMENT WITH A BASE ELEMENT AND CHISEL HOLDER

[75] Inventors: Karl Kammerer, Fluorn-Winzeln, Germany; Bernhard Diessner, Telfes/Stubaital, Austria; Dieter Simons, Buchholz; Bernd Holl, Neustadt/Wied-Fernthal, both of Germany

[73] Assignees: Wirtgen GmbH; Betek Bergbau- Und Hartmetalltechnik Karl-Heinz Simon GmbH & Co. KG, both of Germany

[21] Appl. No.: 578,618

[22] PCT Filed: Jul. 1, 1994

[86] PCT No.: PCT/EP94/02164

§ 371 Date: Jul. 8, 1996

§ 102(e) Date: Jul. 8, 1996

[87] PCT Pub. No.: WO95/02112

PCT Pub. Date: Jan. 19, 1995

[30] Foreign Application Priority Data

Jul. 6, 1993 [DE] Germany ..... 43 22 401.6

[51] Int. Cl.[6] ..... E21C 35/193

[52] U.S. Cl. ..... 299/102; 299/106

[58] Field of Search ..... 299/102, 106, 299/108

[56] References Cited

U.S. PATENT DOCUMENTS

| | | | |
|---|---|---|---|
| 3,992,061 | 11/1976 | Rollins | 299/102 |
| 4,343,516 | 8/1982 | Aden | 299/106 |
| 4,915,455 | 4/1990 | O'Neill et al. | 299/102 |

FOREIGN PATENT DOCUMENTS

| | | | |
|---|---|---|---|
| 3359071 | 3/1973 | Australia . | |
| 6208773 | 2/1974 | Australia . | |
| 734713 | 4/1943 | Germany . | |
| 1915152 | 10/1970 | Germany . | |
| 343448 | 2/1986 | Germany . | |
| 3503224 | 8/1986 | Germany . | |
| 9211739 | 12/1992 | Germany . | |
| 9310021 | 12/1993 | Germany . | |
| 1550353 | 8/1979 | United Kingdom | 299/108 |
| 2207691 | 2/1989 | United Kingdom | 299/102 |

*Primary Examiner*—David J. Bagnell
*Attorney, Agent, or Firm*—Speckman, Pauley & Fejer

[57] ABSTRACT

A cylindrical cutting element for a cutting machine which includes base parts arranged at a uniform distance from each other. A chisel holder which receives an exchangeable chisel is secured with respect to each base element. The chisel holder has a plug connector which allows the chisel holder to be inserted into a plug receiver of the base element, where it is held by a pressure screw on the base part that grips the plug connector. To relieve the plug connector from the forces acting on the chisel, the base part has a projection which extends in an approximately parallel direction to the running direction of the cutting element and a stop that follows the projection in the running direction and forms an angle therewith. The stop limits the insertion of the chisel holder into the base element and absorbs forces transmitted through the chisel to the chisel holder.

10 Claims, 2 Drawing Sheets

CUTTING ELEMENT WITH A BASE ELEMENT AND CHISEL HOLDER

BACKGROUND OF THE INVENTION

1. Field of the Invention

This invention relates to a cutting tool which can be fastened on a cylinder-shaped cutting element of a cutting machine. The cutting tool has a base element and a chisel holder. The chisel holder is provided with a plug connector which is maintained in a plug receiver of the base element. The chisel holder has a stop face which rests flat against a stop of the base element.

2. Description of Prior Art

Such a cutting element is known from German Reference DE 92 11 739. A plug connector of the chisel holder is inserted into the plug receiver of the base element. The plug receiver is inclined forward in the direction of running of the cutting element, so that the plug connector is inserted into the base element. A shoulder, disposed behind the plug connector viewed in the direction of running of the cutting element and extending perpendicularly with the axis of the chisel receiver, is used to support a support face of the chisel holder. An edge is formed between the shoulder and the plug receiver, which exerts high edge pressure on the transition area between the plug connector and the support face of the chisel holder during the cutting process. Pulsating stresses occurring in cutting machines lead to alternating loads which quickly result in material fatigue of the chisel holder in the area of the edge, so that the plug connector breaks off and the chisel holder separates from the base element.

Thus, the service life of such a cutting machine is greatly limited, and relatively high costs arise because of necessary repairs and idle periods.

A chisel holder is described in Australian Reference AU-A-3 359 071 on which a chisel can be fixed in place. The chisel holder has a plug receiver. A plug connector of the chisel can be inserted into the plug receiver. A stop follows the plug receiver at an angle, forming an edge. The stop is disposed behind the plug receiver, viewed in the direction of running. A counter surface, corresponding to the stop, is disposed on the plug connector of the chisel. The counter surface is also disposed at an angle to the plug connector, forming an edge. In the inserted state of the chisel in the chisel holder, the edges of the plug receiver and the plug connector rest against each other.

Shock-like loads act on the chisel during operation. Because of the high stresses which typically occur in the area of the touching edges of the chisel holder taught by the '071 reference, such shock-like loads result in material fatigue. Thus premature wear of the chisel or the chisel holder occurs. The downtime of the chisel holder and the necessary replacement connected therewith are expensive, since the old chisel holder which is welded on a cutting roller must first be removed, and then a new chisel holder must be welded on the cutting roller in place of the old chisel holder.

SUMMARY OF THE INVENTION

It is one object of this invention to provide a cutting element for a cutting machine of the type mentioned at the outset wherein the chisel holder can be supported and held in the base element without danger of the plug connector breaking.

According to one preferred embodiment of this invention, the base element has a shoulder arranged around the plug receiver and is positioned at a distance from the chisel holder. The shoulder together with the stop form an obtuse-angled receiver for the chisel holder.

The chisel holder is thus supported flat on the stop. Depending on the direction of introduction of the force, the stop is inclined with respect to the shoulder so that stress on the base element is reduced. Because the chisel holder is spaced apart from the shoulder in the area around the plug receiver, the force upon the chisel is absorbed by the shoulder. The plug connector is kept free of stress.

Thus, damage to the plug receiver of the base element is impossible, and the useful service life of such a cutting tool is considerably increased.

According to one preferred embodiment of the cutting element of this invention the obtuse angle is approximately between 120° and 130°.

According to another preferred embodiment of this invention, the chisel holder has at least two chisel receptacles to perform precision treatment of surfaces.

If, for example, it is intended to level a road covering, the chisel receivers can be disposed at a distance with respect to each other in the axial direction of the cutting body. In this way precision processing of the road covering is possible. A subsequent treatment of the cut surface is not required because of the high surface sides which can be achieved.

According to another preferred embodiment of this invention, a rapid and simple exchange of the chisel is achieved by forming a tool opening in the base element. The tool opening permits access to the end of the chisel receiver which is supported at the stop.

The plug connector can be inserted so that the side of the chisel holder facing the shoulder of the base element is spaced apart from the shoulder. This enables the forces introduced by the chisel to be completely transmitted to the stop.

To secure the chisel holder with respect to the base element, the plug receiver of the base element can have a Vee-guide which cooperates with corresponding guide faces of the plug connector of the chisel holder.

BRIEF DESCRIPTION OF THE DRAWINGS

The invention will be explained in detail below by means of one preferred embodiment of a cutting element according to this invention, wherein.

DESCRIPTION OF PREFERRED EMBODIMENTS

Figure 1:
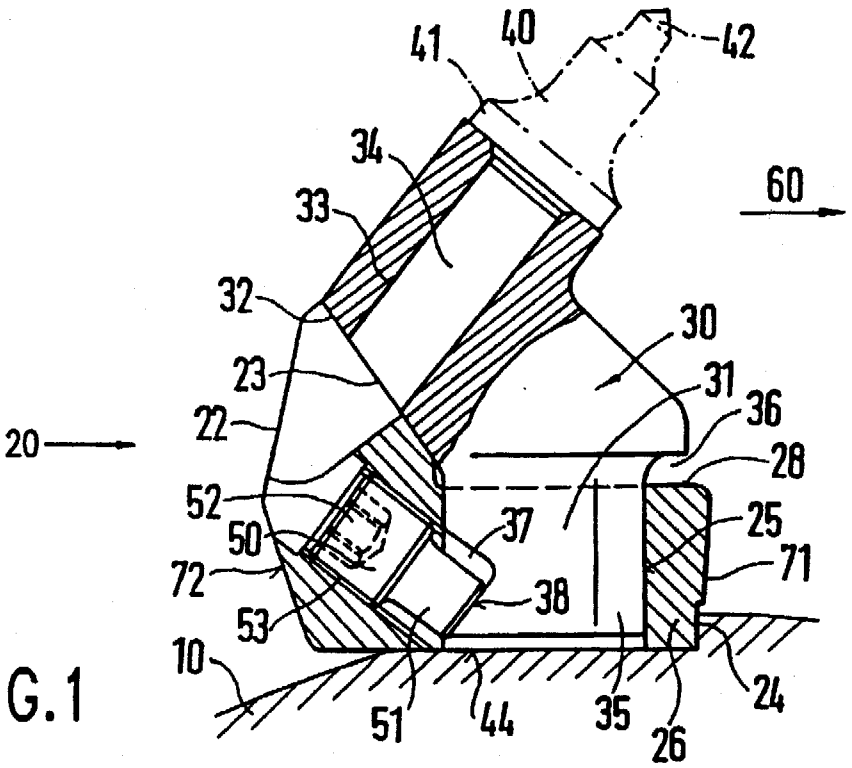
FIG. 1 shows a partial cross-sectional side view of a base cutting element according to one preferred embodiment of this invention.
Figure 2:
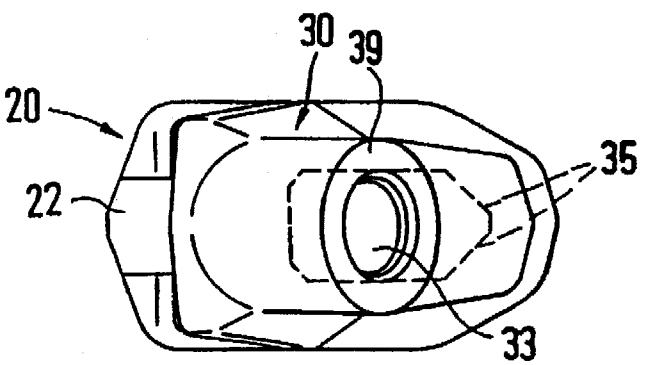
FIG. 2 shows a top view of a base and a cutting element according to another preferred embodiment of this invention.
Figure 3:
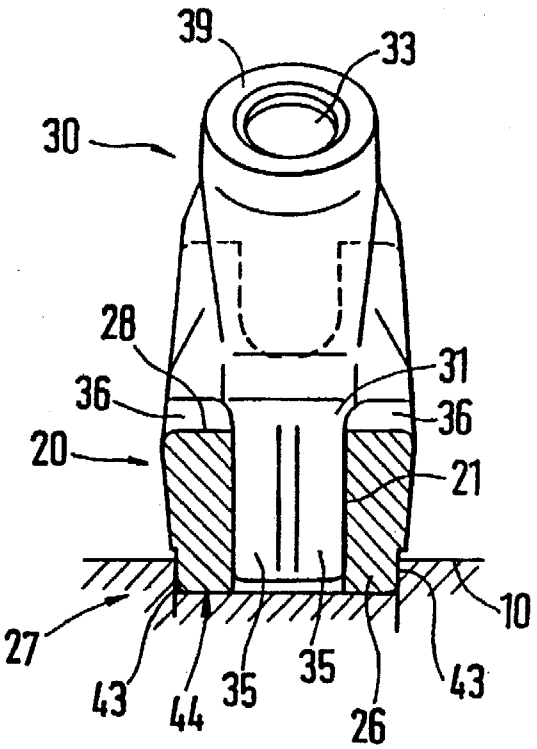
FIG. 3 shows a front view of a base element without a chisel.
Figure 4:
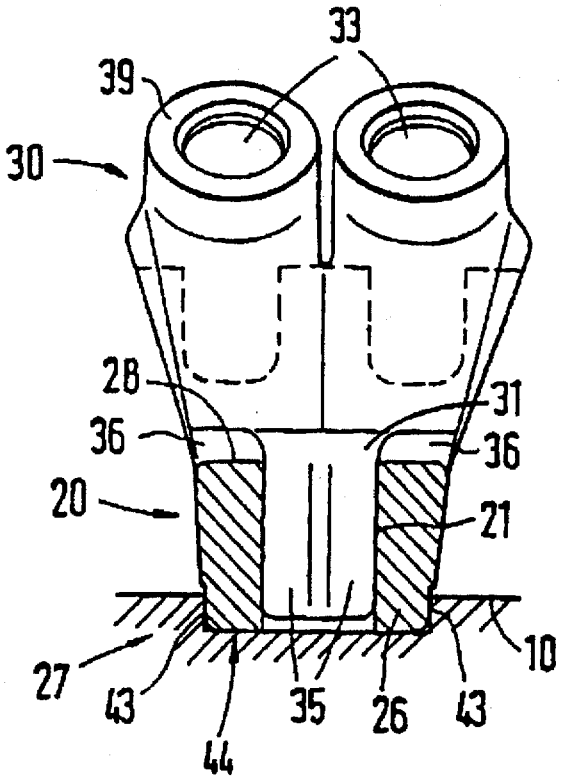
FIG. 4 shows a front view of a chisel holder having two chisel receivers in accordance with one embodiment of this invention.
Figure 5:
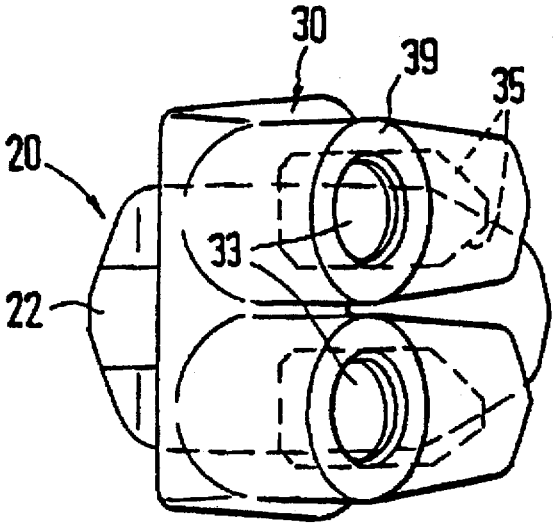
FIG. 5 shows a top view of the chisel holder shown in FIG. 4.

A base element 20 with an exchangeable chisel holder 30 is shown in FIGS. 1–3. The cutting element has pocket receptacles 27 on cutting element surface 10, as shown in FIG. 3. A foot 26 of the base elements 20 have been positioned in the pocket receptacles 27. The inserting movement of the base element 20 into the pocket receptacle 27 is limited by a stop 24, which secures the base element 20 on the front of the base element 20. Welding can be provided to securely fasten the base element 20 with respect to the cutting element. The base element 20 has a plug receiver 21 cut into a shoulder 28 disposed approximately parallel with the direction of running 60 of the cutting element. A stop 32 has been formed at an obtuse angle on the base element 20 at the back of the base element 20, viewed in the direction of running 60. A plug connector 31 of the chisel holder 30 is inserted into the plug receiver 21 of the base element 20. A Vee-guide 25 is attached to the front of the plug receiver 21 and is used for guiding and receiving guide faces 35 of the plug connector 31. The insertion movement of the chisel holder 30 is limited by a stop face facing the stop 32 of the base element 20. A gap 36 is formed between the shoulder 28 of the base element 20 and the side of the chisel holder 30 facing the shoulder 28, so that the chisel holder 30 is only supported on the stop 32.

The back portion of the plug connector 31 has a V-shaped cutout 37. One leg of the V-shaped cutout 37 is used as a pressure face 38 for a pressure screw 50. A screw thread 53 of the pressure screw 50 is screwed into a threaded receiver of the base element, so that the shaft 51 cooperates with the pressure face 38. When tightening the pressure screw 50, the plug connector 31 is drawn into the plug receiver 21 and simultaneously pressed into the Vee-guide 25 at the front. A chisel receiver 33 is formed in the chisel holder 30 and receives a shaft element of a chisel 40. A ring-shaped contact face 39 is formed on the side of the chisel receiver 33 facing the chisel head 42. The chisel 40 is supported on the ring-shaped contact face 39 by a collar 41. The chisel 40 is secure against axial lift by a clamping sleeve, not shown in the drawings. A tool opening 22 can be formed in the base element 20 on the end of the chisel receiver 33 facing away from the contact face 39, which provides access to the end of the chisel holder 40 remote from the chisel head 42. It is therefore possible to drive the chisel 40 out of the chisel receiver 33 from the back of the base element 20 by a pin and a hammer. The pressure screw 50 can comprise a headless stud screw, so that it does not project into the tool opening 22 and thus does not hamper the tool exchange. A tool receiver 52, for example for receiving an Allen key or a torque wrench, can be formed in the front face of the pressure screw 50.

The base elements 20 are linearly positioned and fastened on the cutting element surface 10 to form a removal and loading screw or removal spiral. In the process, a front joining face 71 of a base element 20 is positioned against a rear joining face 72 of an adjacent base element 20 and fastened on the cutting element.

In the preferred embodiment Shown in FIGS. 1–3, the base element 20 is welded together with the cutting element surface 10. However, it is apparent that other suitable means could be used to fix base element 20 with respect to cutting element surface 10, including by using a screw connection.

We claim:

1. A cylinder-shaped cutting element for a cutting machine having one of a removal and loading screw and a removal spiral comprising a plurality of base elements disposed at even distances and projecting from the cutting element surface, a chisel holder adapted to interchangeably receive a chisel connected to each base element, the chisel holder having a plug connector insertable into a plug receiver of the base element and held therein on the base element by a pressure screw acting on the plug connector, the improvement comprising:

the base element (20) having a shoulder (28) at a front of said cutting element, extending approximately parallel to a direction of running (60) of the cutting element and, following at a back of said cutting element in the direction of running (60), a stop (32) disposed at an obtuse angle to the shoulder (28), thereby limiting an insertion movement of the chisel holder (30) into the base element (20) and absorbing the forces transmitted through the chisel (40) to the chisel holder (30).

2. A cutting element in accordance with claim 1, wherein the obtuse angle is approximately 120° to approximately 130°.

3. A curing element in accordance with claim 2, wherein the chisel holder (30) comprises at least two chisel receivers (33).

4. A cutting element in accordance with claim 3, wherein the at least two chisel receivers (33) are disposed next to and at a distance with respect to each other in an axial direction of the cutting element.

5. A cutting element in accordance with claim 4, wherein a distance between the at least two chisel receivers (33) is approximately 45 mm.

6. A cutting element in accordance with claim 5, wherein the base element (20) forms a tool opening (22), and the tool opening (22) provides access to the end of the at least two chisel receivers (33) supported on the stop (32).

7. A cutting element in accordance with claim 6, wherein the plug receiver (21) of the base element (20) forms a Vee-guide (25) which mates with corresponding guide faces (35) of the plug connector (31) of the chisel holder (30).

8. A cutting element in accordance with claim 1, wherein the chisel holder (30) comprises at least two chisel receivers (33).

9. A cutting element in accordance with claim 1, wherein the base element (20) forms a tool opening (22), and the tool opening (22) provides access to the end of a chisel receiver (33) supported on the stop (32).

10. A cutting element in accordance with claim 1, wherein the plug receiver (21) of the base element (20) forms a Vee-guide (25) which mates with corresponding guide faces (35) of the plug connector (31) of the chisel holder (30).

* * * * *